US010646043B1

(12) United States Patent
North

(10) Patent No.: US 10,646,043 B1
(45) Date of Patent: May 12, 2020

(54) EASILY MANIPULABLE STOOL

(71) Applicant: David G. North, Gold Canyon, AZ (US)

(72) Inventor: David G. North, Gold Canyon, AZ (US)

( * ) Notice: Subject to any disclaimer, the term of this patent is extended or adjusted under 35 U.S.C. 154(b) by 68 days.

(21) Appl. No.: 15/964,409

(22) Filed: Apr. 27, 2018

(51) Int. Cl.
*A45D 19/04* (2006.01)
*A47C 7/00* (2006.01)
*A47C 9/02* (2006.01)

(52) U.S. Cl.
CPC ..... *A47C 7/006* (2013.01); *A47C 9/027* (2013.01)

(58) Field of Classification Search
CPC ..... A47C 7/006; A47C 9/027
USPC ..... 248/127; 182/230; 297/236
See application file for complete search history.

(56) References Cited

U.S. PATENT DOCUMENTS 2,625,989 A * 1/1953 Pond ..... A47C 9/02 248/127
2017/0099954 A1* 4/2017 Chao ..... A47C 9/027

FOREIGN PATENT DOCUMENTS

WO WO2011130160 A3 2/2012

* cited by examiner

*Primary Examiner* — Todd M Epps
(74) *Attorney, Agent, or Firm* — Sanchelima & Associates, P.A.; Jesus Sanchelima; Christian Sanchelima

(57) ABSTRACT

The present invention is a moveable stool that includes a wheeled member having wheels, a stably support member and at least one flexible element. Stably support member is formed of a bottom cavity, a top flat surface for user to stand on and support element(s). When a user is not standing on top flat surface, then the wheels are free to move and stool is displaceable from one position to another. After the stool reaches at desired position and the user steps up on top flat surface, non-skid support element(s) connects with ground wheels of wheeled member are restricted from movement. Restricted movement of wheels prevents movement of stool on ground/floor. When user steps down from top flat surface, flexible element(s) retracts stably support member which raises support element(s) and disconnects contact between support element and ground. Wheels in contact with ground/floor are freed rendering stool again for portability.

13 Claims, 5 Drawing Sheets

EASILY MANIPULABLE STOOL

BACKGROUND OF THE INVENTION

1. Field of the Invention

The present disclosure relates to a portable stool useful for work on ground. More particularly, the present disclosure relates to a stool that is easily manipulated for movement from one position to another and provides stability while in use.

2. Description of the Related Art

Stools or tables are frequently required in day to day life for climbing up to reach a height and perform an activity. Stool needs to be lifted, carried in vicinity area where activity is to be preformed and position in the area. The activity of lifting and positioning requires bending each time and hence is tedious. Further, it is not easy to carry weight of stool and move from one corner to another. Activities of lifting, carrying and positioning are difficult to be performed by children who are main user of stools owing to their less height and also is inconvenient for old age personals. Conventionally, mechanism like hydraulic or pneumatic are provided that raises height of stool/table or makes stool/table collapsible, however, such mechanisms does not provide ease of handling or manipulating stool/table from one position to another.

Several designs of various stools have been designed in the past. None of them, however, include an easily manipulable stool for easy movement of stool from one position to another and provide adequate stability while in use.

Applicant believes that a related reference corresponds to WIPO patent application WO2011130160 filed by White Pine Concepts Llc titled "A gardening stool and a method for using same" discloses a stool that includes a body having a seat and a wheel assembly. However, the disclosure does not explicitly mention about locking of wheels and is mainly used for gardening purpose and not suitable to be used in-house. Also, owing to the size, the portability of stool from one place to another is difficult and requires more efforts.

Another US patent U.S. Pat. No. 2,625,989 filed by Kenneth H Pond and Rogers Frederick titled "Rolling stool having means to lock it against rolling" discloses a free-rolling stool or chair with a means which permits the locking of the stool or chair in a desired position relative to the floor or base on which it rolls. However, user can move stool while sitting on stool and pushing with his/her feet. Such stools are though useful for dentist to move in defined area but however are uncomfortable to be carried from one room to another. Also, stool is difficult to handle by children and old age personal.

Other documents describing the closest subject matter provide for a number of more or less complicated features that fail to solve the problem in an efficient and economical way. None of these patents suggest the novel features of the present invention.

SUMMARY OF THE INVENTION

In view of the above, it is an objective of the present invention to solve or at least reduce the problems discussed above. The present invention is an easily movable stool that includes a stably support member and a wheeled member that contains wheels and at least one flexible element. Stably support member is formed of a bottom cavity, a top flat surface for user to stand on and non-skid support element(s) that can be easily manipulated/positioned. When user is besides stool and is not standing on top flat surface, stably support member is displaced off/moves away from the ground/floor breaking contact between non-skid support element(s) and the ground/floor. User can then manipulate stool by using their foot from one position to another by moving stool on wheels which are always in contact with the ground/floor. After stool is manipulated by foot to desired position, then user can step up on top flat surface of stably support member and stably support member displaces towards the ground/floor such that non-skid support element(s) touch ground/floor. Flexible element(s) compresses during movement of stably support member towards the ground/floor. Wheels of wheeled member are surrounded by bottom cavity of stably support member and even though wheels are in contact with the ground/floor, the movement of wheels is restricted because of contact established between non-skid support element(s) with ground/floor. Further, when user steps down from top flat surface, flexible element(s) de-compresses causing retraction of stably support member which disconnects contact between non-skid support element(s) and the ground/floor rendering stool for manipulation.

It is one of the main objects of the present invention is to provide a portable stool that is easily and conveniently manipulated/displaced, by using user's foot, from one position to another thus rendering hands-free and also provide stable support when in use.

It is another object of this invention is to provide a portable stool that does not require additional locking/securing elements for locking/securing portable stool on ground/floor and hence is simplified in construction and cost effective.

It is another object of this invention is to provide a portable stool that does not require any additional locking efforts and hence is easy to use.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
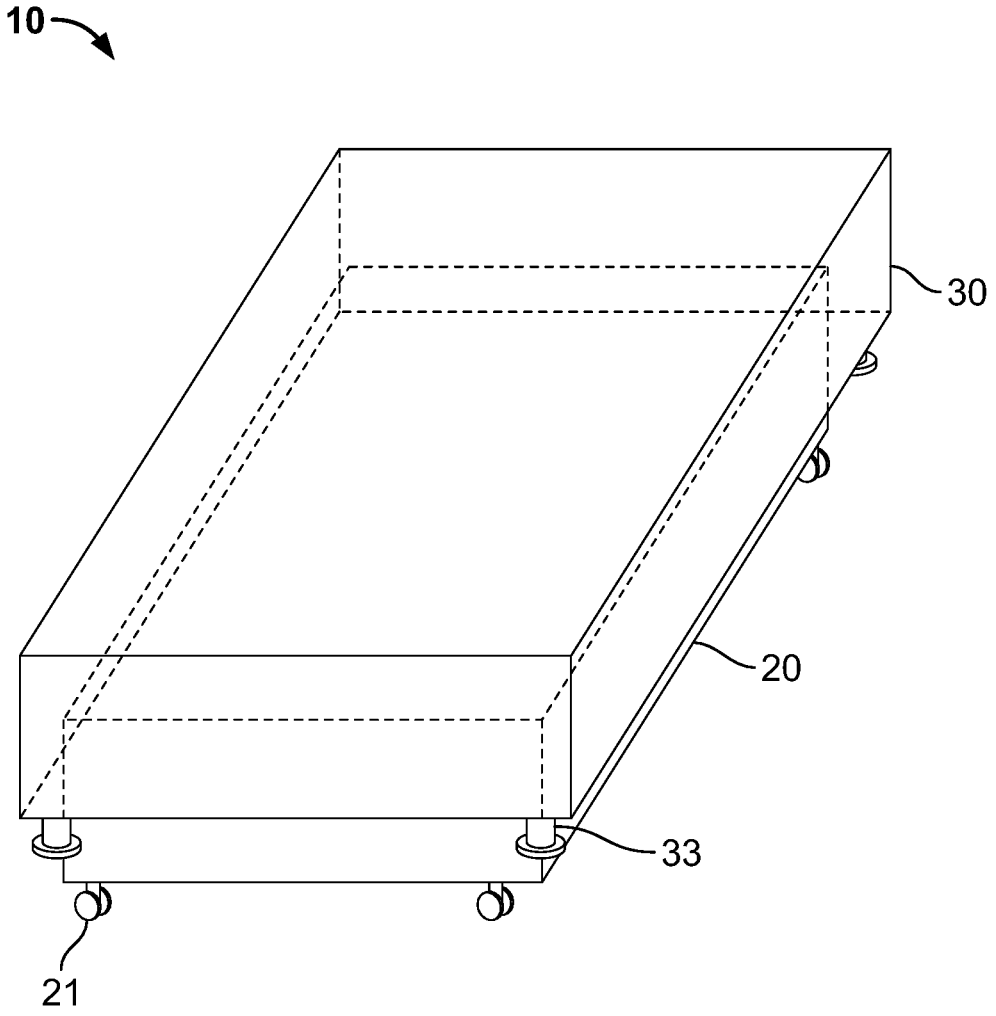
FIG. 1 represents a perspective representation of an easily manipulable stool, in accordance with one embodiment of the present invention, wherein easily manipulable stool is in portable configuration.
Figure 2:
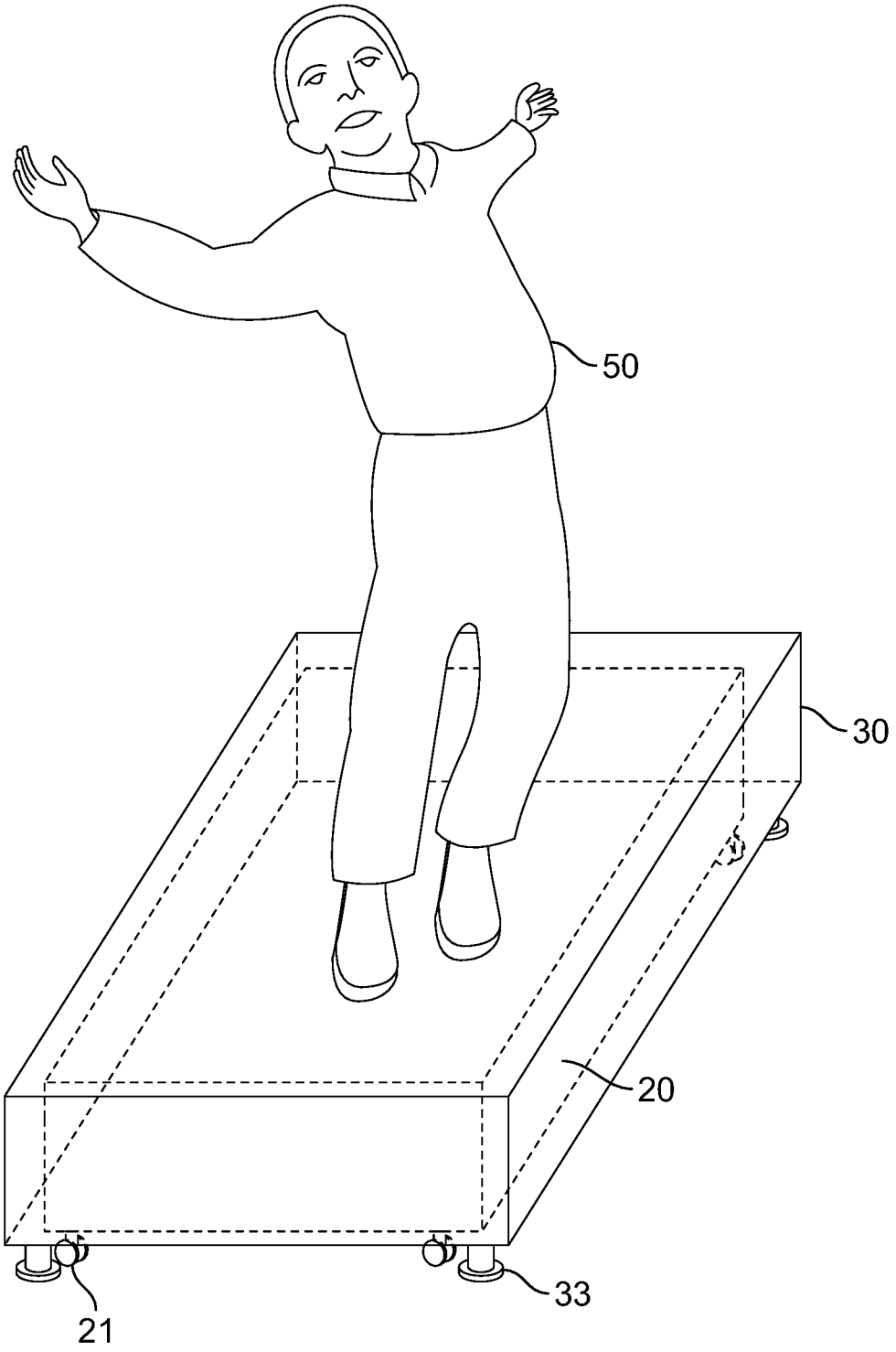
FIG. 2 represents a perspective representation of stool of FIG. 1, wherein stool is in stable configuration.
Figure 3:
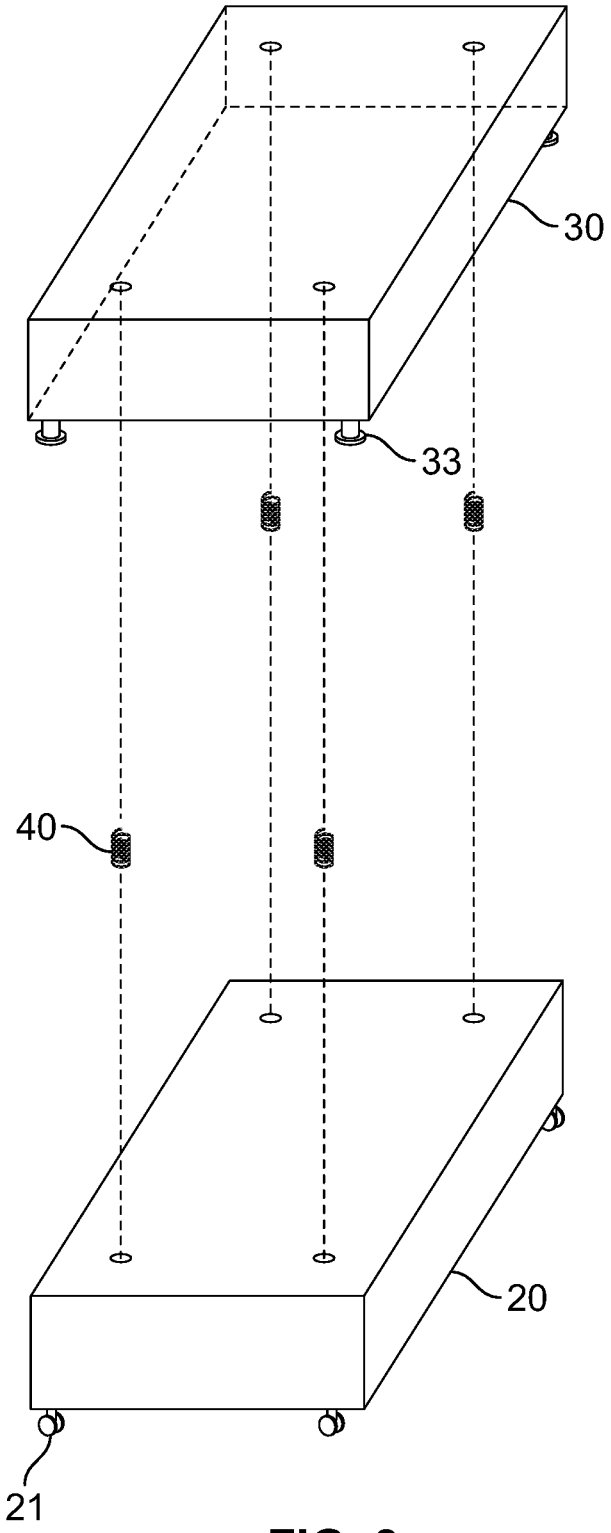
FIG. 3 represents an exploded view of stool of FIG. 1.
Figure 4:
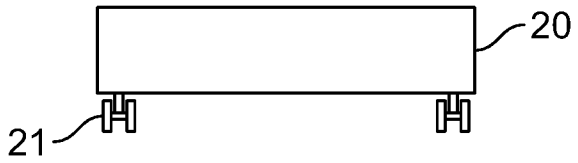
FIG. 4 represents affront view of a wheeled member of stool of FIG. 1.
Figure 5:
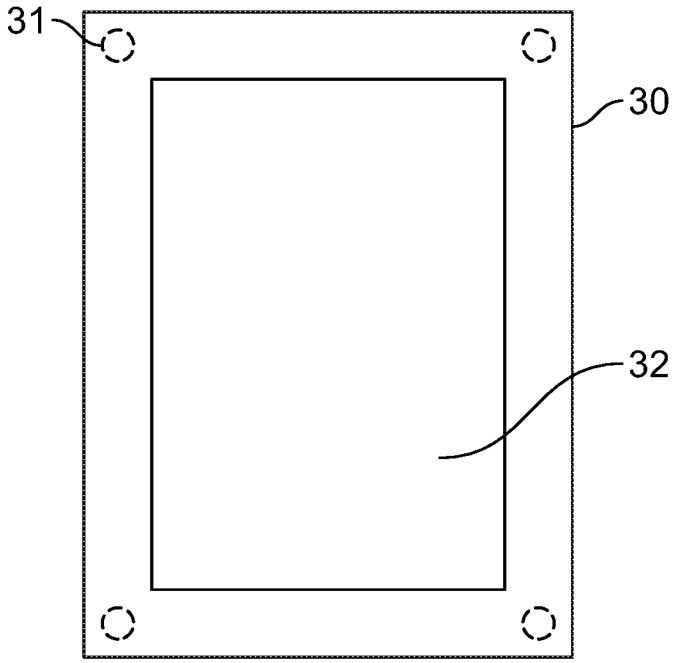
FIG. 5 represent a top view of a stably support member of stool of FIG. 1, on which user can stand.
Figure 6:
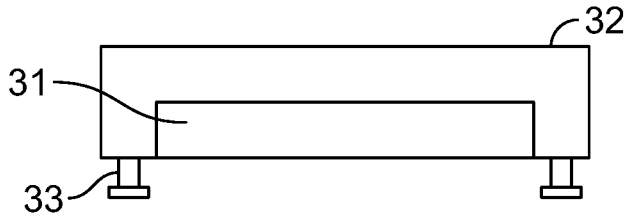
FIG. 6 represent a front view of stably support member of FIG. 5.
Figure 7:
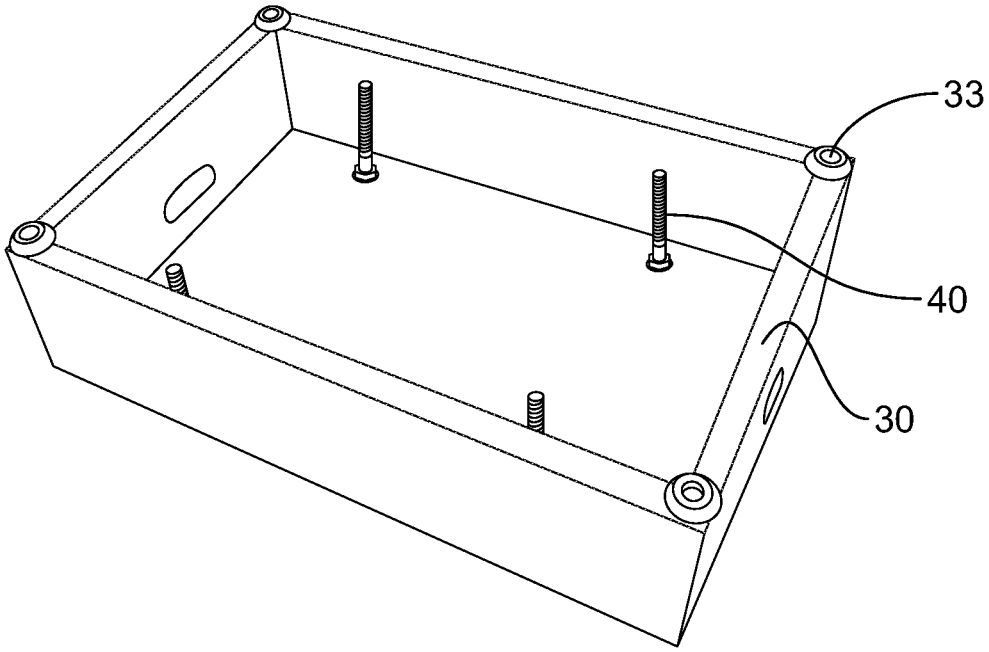
FIG. 7 represent a perspective internal view of stably support member with flexible elements therewithin and also provided with non-skid support elements.
Figure 8:
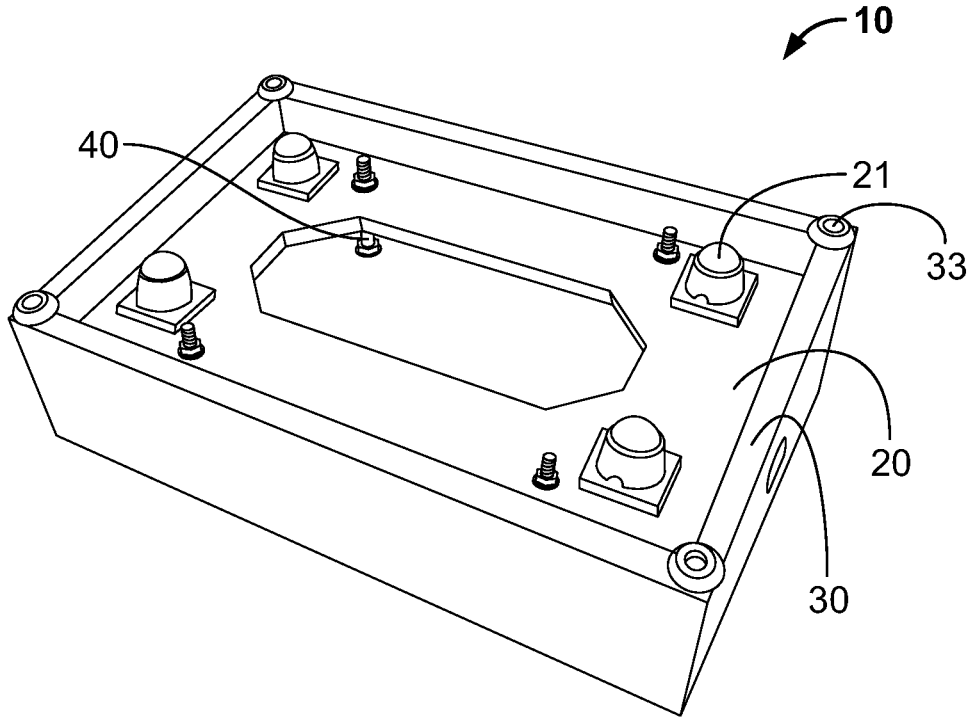
FIG. 8 represent a perspective view of easily manipulable stool in upside-down configuration.

Referring now to the drawings (FIGS. 1 to 8), where the present invention is generally referred to with numeral 10, it can be observed that an easily manipulable stool which is manipulable on ground/floor, in accordance with one embodiment, is provided that includes a wheeled member 20 having wheels 21, a stably support member 30 and at least one flexible element 40.

Wheeled member 20 is a substantially flat element that has one or more number of wheels 21 provided underneath. In depicted embodiment, wheeled member has four wheels. Shape and material of wheeled member 20 can be selected as per user's desire. Depending upon shape and size, number of wheels 21 can be decided.

Stably support member 30 is formed of a bottom cavity 31 and a top flat surface 32. Bottom cavity 31 is of a shape complementary with the shape of wheeled member 20 such that when stably support member 30 displaces towards ground/floor, bottom cavity 31 of stably support member 30 accommodates wheeled member 20. Top flat surface 32 is substantially flat and is provided for user 50 to step on and stand thereon. Top flat surface 32 can be provided with a layer of a non-skid material. Stably support member 30 is further provided with non-skid support elements 33 that are selectively in contact with ground/flat surface. In depicted embodiment, support elements 33 are made of rubber or polymeric elements. Support elements 33 can alternatively be of any other materials that can provide adequate support. Support element 33 can be provided at every corner or can be one continuous element.

Flexible element(s) 40 is provided in between an operative top surface of wheeled member 20 and an operative inner surface of bottom cavity 31. Flexible element(s) 40 is a force contact between wheeled member 20 and stably support member 30. Flexible element(s) 40 facilitates providing relative movement of wheeled member 20 with respect to stably support member 30. Number of flexible element(s) 40 can be decided based on size of wheeled member 20 and stably support member 30 and amount of user's weight levied on top flat surface 32. In one exemplary embodiment, flexible element(s) is preferred as a spring. Alternatively, flexible element(s) can be collapsible shutter like element. Flexible element(s) is not limited to use of springs or collapsible shutter like element and other mechanisms that can act by manipulation of weight is included within the scope of the present disclosure.

In operation, when user 50 is besides stool 10 and not standing on stool 10, stool 10 is free from user's weight then stool 10 achieves a portable/movable configuration in which only wheels 21 are in contact with ground/floor/flat surface. When stool 10 is in portable/movable configuration, user 50 can push stool 10 by using foot. Alternatively, user can push stool 10 by using hands or can use, an optionally provided, a pushing or carry handle (not illustrated in Figures) that can be fixedly or removably connected to stool 10. Upon pushing stool 10, stool 10 moves from a first position to a second position. After stool 10 reaches second position, user 50 steps on top flat surface 32. Upon receiving load of user, stably support member 30 is pushed down and displaces towards ground/floor to compresses flexible element(s) such that wheeled member 20 is accommodated in bottom cavity 31 and support elements 33 touches the ground/floor/flat surface and wheels 21 continue to be on the ground/floor/flat surface. Thus, because of non-skid support elements 33 touching on floor, movement of wheels 21 on the ground/floor is restricted and stool 10 is stably positioned on ground/floor/flat surface. When user steps down, flexible element(s) acts on support elements 33 to raise/lift support elements 33 such that support elements 33 displaces away from ground/floor/flat surface and freeing wheels 21 to achieves portable configuration. Thus, when user 50 is not on stool, stool is in portable configuration and when user is on stool then stool is in stable configuration.

Stool is thus easily portable and is conveniently manipulated/displaced from one position to another and provides stable support when in use. Portable stool does not require additional locking/securing elements or locking efforts for locking/securing portable stool on ground/floor and hence is simplified in construction and cost effective. Portable stool can be easily manipulated by children as well as old age people who have less physical strength from various locations, for instance, from a bedroom to a garage.

The present invention is a rolling footstep that stops rolling once you stand upon it. It allows you to have a convenient motionless elevated step that can be easily rolled and guided to any desired location by simply using your foot. The rolling footstep consists of a hollow platform box and a separate spring-loaded plate with rollers underneath. When stepped upon the springs are compressed allowing the box platform to descend and securely rest in place on the floor. The dimensions of the footstep are 4½" high, 16" long and 10½" wide.

The present invention makes it convenient to have extra height in all kinds of locations, but especially the kitchen, making it comfortable for chopping, cooking and washing, and also reaching up into cupboards. Plus the laundry room, garage or anywhere a little extra elevation is needed. It provides a safe and stable platform for shorter people, children and elderly to stand on to work from. The top of the platform can be covered with a soft outdoor water resistant material with padding around the edges thereby protecting appliances, base boards and cabinet surfaces, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A step stool, comprising:

an upper box-like frame having an interior space, an entirely open bottom side, and a flat top surface, a lower frame being a flat member having a bottom surface with wheel members that extends out of said bottom surface, said upper frame having a larger perimeter than lower frame thereby covering said lower frame; said upper frame having upper frame corners, non-skid support feet that extends out of said upper frame corners; said flat top surface having a bottom side, at least one spring member mounted to said bottom side, said at least one spring penetrates through said lower frame and extends out of said bottom surface and connects said upper frame to said lower frame, said at least one spring member adapted to have an upwards bias that is overcome when a user steps down on said top surface and compresses said at least one spring member, thereby allowing said upper frame to drop down to a ground surface and pushes said lower frame upwards so that said non-skid support feet come into abutting engagement with said ground surface, thereby locking a movement of said wheel members.

2. The step stool of claim 1 wherein said top surface includes a layer of non-skid materials.

3. The step stool of claim 1 wherein said lower frame has a thickness and a top surface that includes four base openings that extend into the thickness of said lower frame, said four base openings are aligned with four top openings that extend through a thickness of said upper frame member, said at least one spring members each positioned in said four base openings and each mounted to a top of said wheel members.

4. The step stool of claim 3 wherein said four top openings and said four base openings are located near said upper frame corners and said lower frame corners, respectively.

5. The step stool of claim 3 wherein said at least one spring member is four spring members each housed within said four base openings and said four top openings.

6. The step stool of claim 3 wherein said at least one spring member is wrapped around a pin, said pin extends through the entire thickness of said lower frame using said four base openings and extends out of said bottom surface, a stopper at a distal end of said pin that exceeds said bottom surface.

7. The step stool of claim 1 wherein said lower frame includes four lower frame corners, said wheel members being four wheel members each located at one of said four lower frame corners.

8. The step stool of claim 1 wherein said upper frame is a rectangle or a square.

9. The step stool of claim 1 wherein said upper and lower frame members each include four perimeter side walls, said upper frame member covers at least half of said four perimeter side walls of said lower frame when mounted thereon.

10. The step stool of claim 1 wherein said non-skid support feet include a non-skid bottom surface.

11. The step stool of claim 1 wherein said non-skid support feet includes a vertical member that extends from said bottom surface, said vertical member mounted to a substantially circular ground engagement end that includes a non-skid bottom surface.

12. The step stool of claim 1 wherein said non-skid support feet is one continuous element that extends along a predetermined area of said bottom surface.

13. The step stool of claim 1 wherein said upper frame member or said lower frame member include an elongated handle adapted to allow a user to push or pull said step stool.

* * * * *